US006986219B1

(12) United States Patent
Raia

(10) Patent No.: US 6,986,219 B1
(45) Date of Patent: Jan. 17, 2006

(54) ROTATABLE INDICATOR TAB ASSEMBLY

(76) Inventor: Christopher Raia, 18 Upham St., Newton, MA (US) 02465

( * ) Notice: Subject to any disclaimer, the term of this patent is extended or adjusted under 35 U.S.C. 154(b) by 0 days.

(21) Appl. No.: 10/999,165

(22) Filed: Nov. 29, 2004

(51) Int. Cl.
*G09F 23/10* (2006.01)

(52) U.S. Cl. ..... 40/359; 40/641

(58) Field of Classification Search ..... 40/359, 40/360, 641; 283/36–43; 116/309, 311, 116/313, 315
See application file for complete search history.

(56) References Cited

U.S. PATENT DOCUMENTS 330,028 A * 11/1885 Jolly ..... 40/113
1,654,545 A * 1/1928 Lindsay ..... 40/359
6,152,067 A * 11/2000 Mathison ..... 116/308

* cited by examiner

*Primary Examiner*—Cassandra Davis
(74) *Attorney, Agent, or Firm*—John M. Brandt

(57) ABSTRACT

A rotatable indicator tab assembly for file systems and the like consisting of a rotatable tab formed of a thin sheet of material such as card stock and a tab support, also formed of a thin sheet of material, having a port for receiving the tab arranged such that the edges of the port and the tab cooperate to provide guide and bearing surfaces and stop positions for rotation of the tab.

5 Claims, 1 Drawing Sheet

ROTATABLE INDICATOR TAB ASSEMBLY

BACKGROUND OF THE INVENTION

1. Field of the Invention

The invention relates to file folders and the like and associated tabs which may be positioned in an alternative relationship by rotation with the folder or other such structure to display information in a variety of ways.

2. Description of the Prior Art

Index tabs that pivot or rotate on file folders, jackets, and similar devices exist in the prior art. Examples are U.S. Pat. No. 958,050, Whipple; U.S. Pat. No. 1,008,352, Meyers; U.S. Pat. No. 1,654,545 and U.S. Pat. No. 1,697,985, Lindsay; and U.S. Pat. No. 5,341,982, Sayers. All of the aforementioned as well as currently available commercial items known to the inventor utilizing a rotatable index tab employ a rivet. The rivet joins the tab at a desired position on a file folder and provides the pivot about which the tab rotates.

In contrast to the prior art and as described in detail below, the preset device eliminates the conventional rivet and instead provides a unique assembly of a rotatable tab and tab support. In the invention, the tab fits into a specially configured port in a tab support positioned at any selected position on the face of the support. The elimination of the rivet provides an obvious advantage of cost saving in the manufacture of these products.

SUMMARY OF THE INVENTION

The invention may be summarized as a rotatable indicator tab suitable for file systems or similar products such as point of sale displays where it is desired to convey information by the position of the tab in relation to a support on which it is mounted. The tab, constructed of a thin sheet of material, is of a specific configuration arranged to fit into a port placed at a desired location on the support. The support is also constructed of a thin sheet of material and is of a shape such that the outer edges of the tab and the edges of the port cooperate and interact to mutually provide a rotational bearing surface and stop position arrangement.

Specifically, the tab of the invention is composed of an upper and lower portion having a pair of opposed extensions positioned between the two to form a cross. The port has curved, for example, concentrically arranged semi-circular inner and outer edges. In operation, the tab is inserted into the port such that the top and bottom portions lie on one side of the support and the extensions lie on the other. The corners formed by the tab lower portion and the extensions thereupon engage the outer edge of the port to form a cooperative rotational bearing surface, and the corners formed by the tab upper portion and the extension engage the inner edge of the port to provide limitations on the distance the tab will rotate in either direction.

The tab and port may be located anywhere on the support but preferably will be positioned such that the tab extends beyond one or more edges of the support, the corner of a file folder for example.

The features, advantages, and structure of the invention will become more evident from the description of the preferred embodiment in conjunction with the drawings which follows.

DESCRIPTION OF THE PREFERRED EMBODIMENT

Figure 1:
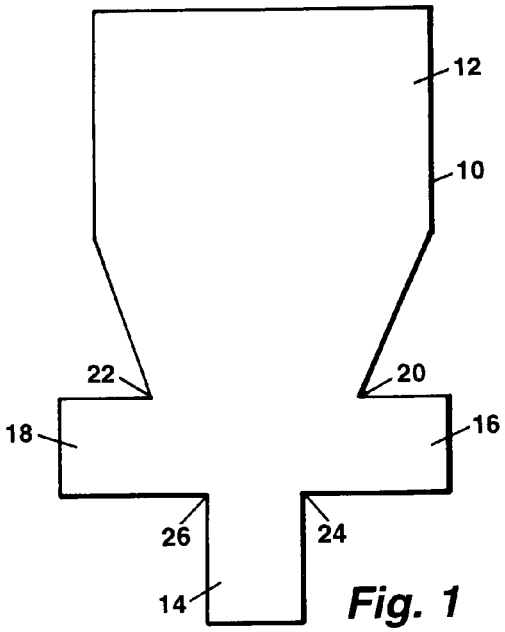
FIG. 1 is a plan view of one component of the preferred embodiment of the invention.

Referring first to FIG. 1, there is shown a plan view of a rotatable tab 10 forming the first component of the invention. Tab 10 is composed of upper portion 12, lower portion 14 and two opposed extension portions 16 and 18 positioned between the upper and lower portions. Upper portion 12 forms two upper corners 20 and 22 with extensions 16 and 18. Similarly, lower portion 14 forms two lower corners 24 and 26 with extensions 16 and 18.

Figure 2:
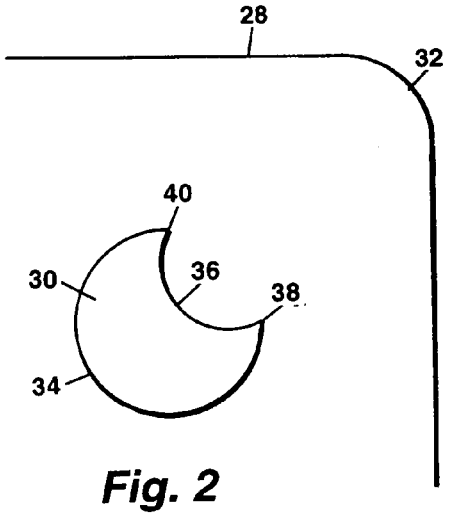
FIG. 2 is a plan view of a second component of the preferred embodiment of the invention.

FIG. 2 is a plan view of tab support 28, the second component of the invention. Port 30 is disposed in support 28 at any desired location, in tab support corner 32 for example. The port is formed of a curved substantially semi-circular outer edge 34 and a curved substantially semi-circular inner edge 36. The convergence of the two edges form a pair of spaced apart acute intersections 38 and 40. Both the tab and tab support are preferably composed of a thin sheet material such as card stock. As shown, support 28 may comprise one sheet of a file folder.

Figure 3:
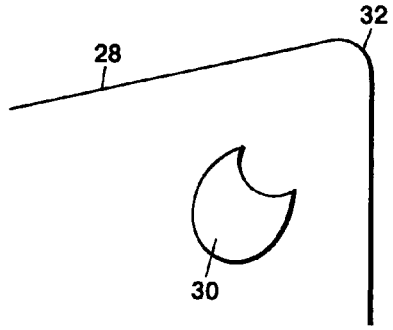
FIG. 3 is a perspective view of the component of FIG. 2.
Figure 4:
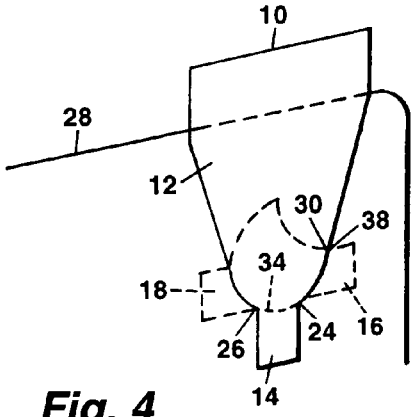
FIG. 4 is a perspective view of the components of FIGS. 1 and 2 joined together in a first position.
Figure 5:
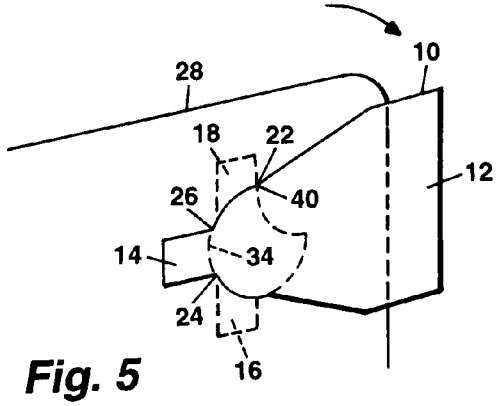
FIG. 5 is a perspective view of the components of FIGS. 1 and 2 joined together in a second position.

FIGS. 3, 4, and 5 are perspective views of the invention, FIG. 3 being a perspective view of FIG. 2 and FIGS. 4 and 5 showing the afore described components joined together. Tab 10 is held in place on support 28 by extensions 16 and 18 fitting through port 30 so as to be on the opposite side of the support from tab upper and lower portions 12 and 14.

Tab lower corners 24 and 26 contact port outer edge 34 which forms a bearing and guide surface for the rotation of the tab. As shown in FIG. 4, tab upper corner 20 interacts with port intersection 38 to limit the rotational travel of the tab and secure it to the support. FIG. 5 illustrates tab 10 rotated 90 degrees from one edge of the support to the other. Tab upper corner 22 interacts with port intersection 40 which, again, limits the extent of the rotational and prevents the tab from separating from the support.

The invention presented herein is not limited to file folders and may be positioned anywhere on a planar surface. For example, the tab may be placed at the top of a file folder so as to only be visible in an upright position. It may be used on the face of a planar surface constituting a point of sale display to indicate the availability of stock or a need to reorder. Further, the tab might be arranged rotate more or less than ninety degrees as shown depending on the configuration of the port.

As variations in the above-described preferred embodiment may be made within the general concept of the disclosure, the invention is accordingly defined by the following claims.

What is claimed is:

1. A rotatable indicator tab assembly for file systems and the like comprising in combination:

A. a rotatable tab comprised of a thin sheet of material, said tab having an upper body portion for information display, a lower body portion, and two opposed extension portions positioned between said upper and lower body portions, said extension portions forming two spaced apart upper corners with said upper body portion and two spaced apart lower corners with said lower body portion; and B. a tab support consisting of a thin sheet of material having a port for receiving said tab, said port having a curved outer edge and a curved inner edge, said edges intersecting to form a pair of spaced apart acute intersections whereby, when said tab is inserted in said port, said extensions lie on one side of said sheet, said upper and lower body portions lie on the opposite side of said sheet, and whereby said lower corners intersect with said curved outer edge of said port and said upper corners intersect with said acute intersections of said port upon rotation of said tab.

2. The tab assembly of claim one wherein said port edges are substantially semi-circular.

3. A rotatable indicator tab assembly for file systems and the like comprising in combination:

A. a rotatable tab comprised of a thin sheet of material, said tab having an upper body portion for information display, a lower body portion, and two opposed extension portions positioned between said upper and lower body portions, said extension portions forming two spaced apart upper corners with said upper body portion and two spaced apart lower corners with said lower body portion; and B. a tab support consisting of a thin sheet of material having two intersecting sheet edges forming a corner, said sheet having a port positioned in said corner for receiving said tab, said port having a curved outer edge and a curved inner edge, said edges intersecting to form a pair of spaced apart acute intersections whereby, when said tab is inserted in said port, said extensions lie on one side of said sheet, said upper and lower body portions lie on the opposite side of said sheet, and whereby said lower corners intersect with said curved outer edge of said port and said upper corners intersect with said acute intersections of said port upon rotation of said tab from one of said sheet edges to the other.

4. The tab assembly of claim 3 wherein said port edges are substantially semi-circular.

5. The tab assembly of claim 4 wherein said tab support comprises at least a portion of a file folder.

* * * * *